United States Patent [19]

Zepf

[11] Patent Number: 4,937,798

[45] Date of Patent: Jun. 26, 1990

[54] ELAPSED-TIME METER

[75] Inventor: Hubert Zepf, Frittlingen, Fed. Rep. of Germany

[73] Assignee: Hengstler GmbH, Aldingen, Fed. Rep. of Germany

[21] Appl. No.: 335,758

[22] Filed: Apr. 10, 1989

[30] Foreign Application Priority Data

Apr. 16, 1988 [DE] Fed. Rep. of Germany ... 8805055[U]

[51] Int. Cl.[5] ..... G04B 19/20; G04F 8/00

[52] U.S. Cl. ..... 368/78; 368/107

[58] Field of Search ..... 368/76, 78, 107, 110, 368/113, 222

[56] References Cited

U.S. PATENT DOCUMENTS 2,762,190 9/1956 Holzner ..... 368/78

3,590,572 7/1971 Niznik ..... 368/78

3,823,546 7/1974 Gortz et al. ..... 368/78

3,898,792 6/1975 Insley et al. ..... 368/78

*Primary Examiner*—Vit W. Miska

*Attorney, Agent, or Firm*—Balogh, Osann, Kramer, Dvorak, Genova & Traub

[57] ABSTRACT

In an elapsed-time meter, which comprises indicating digit wheels, which are mounted in a housing and operable by an electric motor via an interposed transmission, the rotor of the drive motor is rotatably mounted at one end in a partition contained in the housing and at the other end in a mounting plate, which on the side that is remote from the partition carries the transmission and which is integrally formed with resilient lugs, which cooperate with detent noses carried by the partition to detachably fix the mounting plate in position.

14 Claims, 4 Drawing Sheets

ELAPSED-TIME METER

BACKGROUND OF THE INVENTION

Field of the Invention

This invention relates to an elapsed-time meter, which comprises indicating digit wheels, which are mounted in a housing and operable by an electric motor via an interposed transmission.

Various types of elapsed-time meters are known, e.g., for energization by d.c. and a.c. current, for various voltages and for various applications. For this reason the existing elapsed-time meters embody various designs. In a known elapsed-time meter for energization by a.c. current a synchronous motor energized by the desired supply voltage is incorporated in a housing and drives the indicating elements via a multi-stage transmission.

SUMMARY OF THE INVENTION

In view of the trend to miniaturize such meters it is an object of the invention to provide an elapsed-time meter which is compact but does not involve a sacrifice as regards the resolution and the indicating capacity.

In an elapsed-time meter which is of the kind described first hereinbefore and energized by a.c. current that object is accomplished in accordance with the invention in that the rotor of the drive motor is rotatably mounted at one end in a partition contained in the housing and at the other end in a mounting plate, which on the side that is remote from the partition carries the transmission and which is integrally formed with resilient lugs, which cooperate with detent noses carried by the partition to detachably fix the mounting plate in position.

It is apparent that in accordance with the invention as many functions as possible which have previously been performed by separate subassemblies are integrated in the main components. Besides, for meters to be energized with various supply voltages it is sufficient to provide a single drive motor for a single rated voltage because an adaptation can be effected by means of a series resistor having a suitable resistance value.

DETAILED DESCRIPTION OF THE PREFERRED EMBODIMENT

Figure 1:
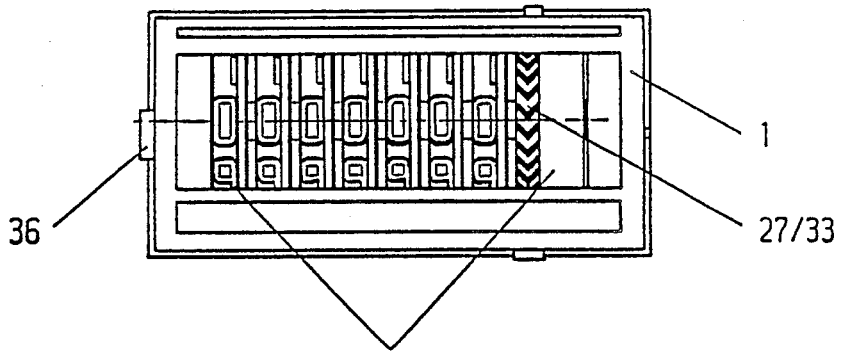
FIG. 1 is a front elevation showing an elapsed-time meter.
Figure 2:
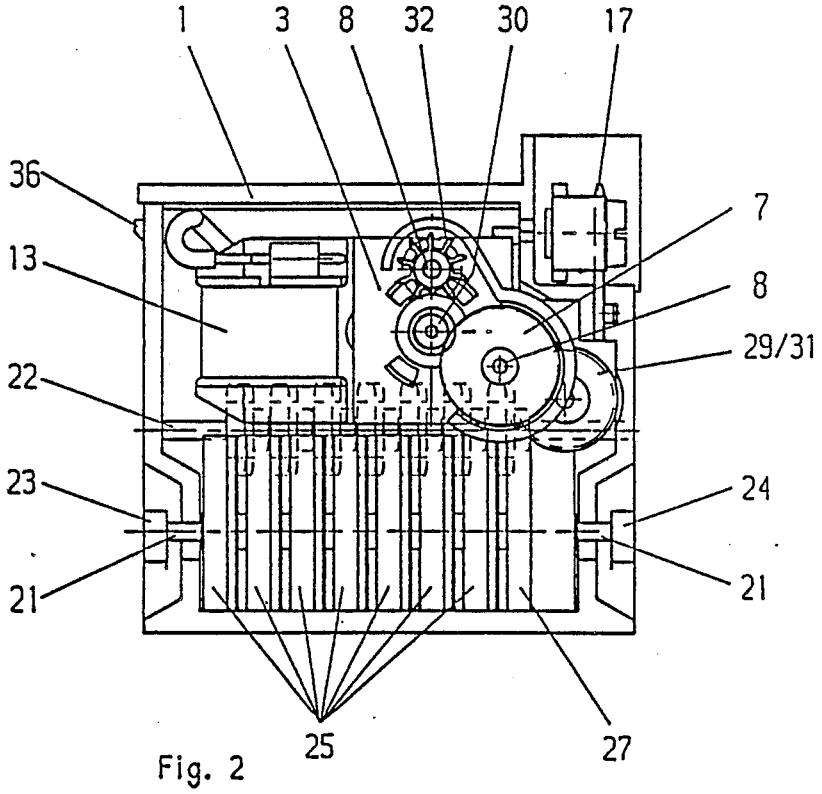
FIG. 2 is a top plan view showing the complete meter of FIG. 1.
Figure 3:
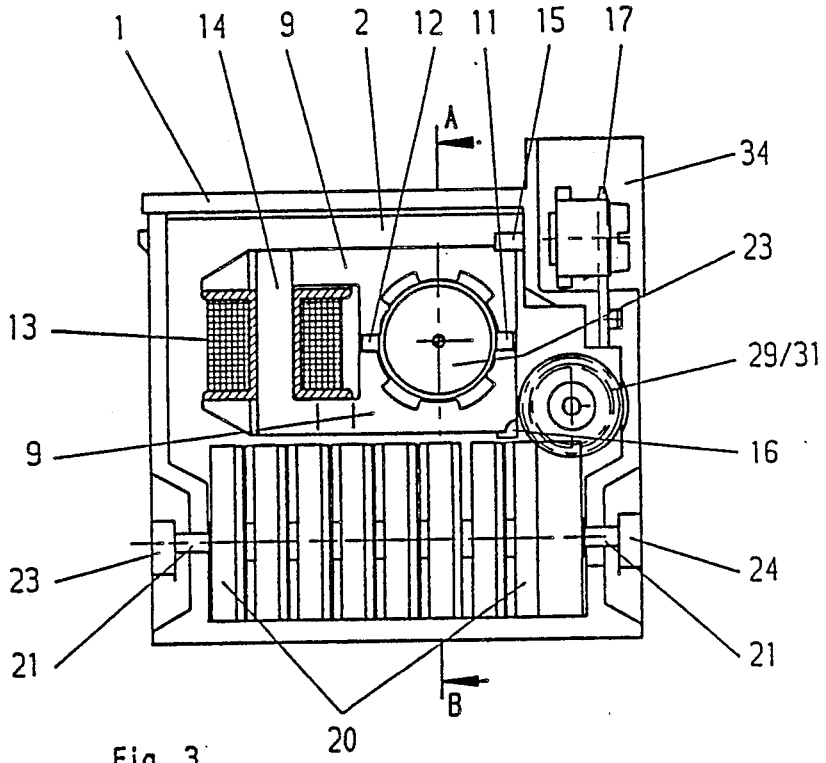
FIG. 3 is a top plan view showing the meter of FIG. 1 with only part of its components.
Figure 4:
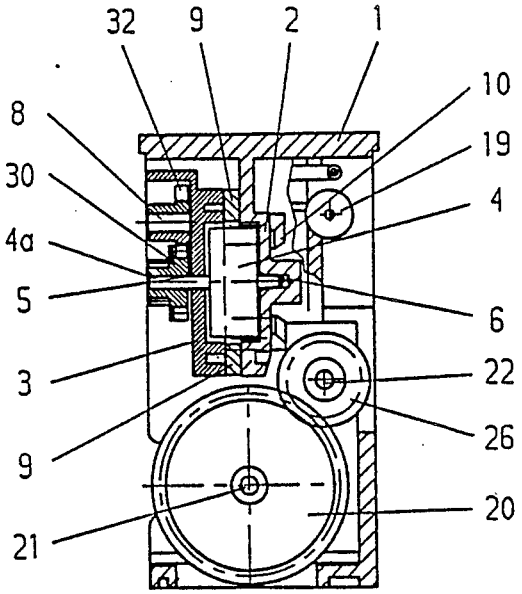
FIG. 4 is a sectional view taken on line A-B in FIG. 3.
Figure 5:
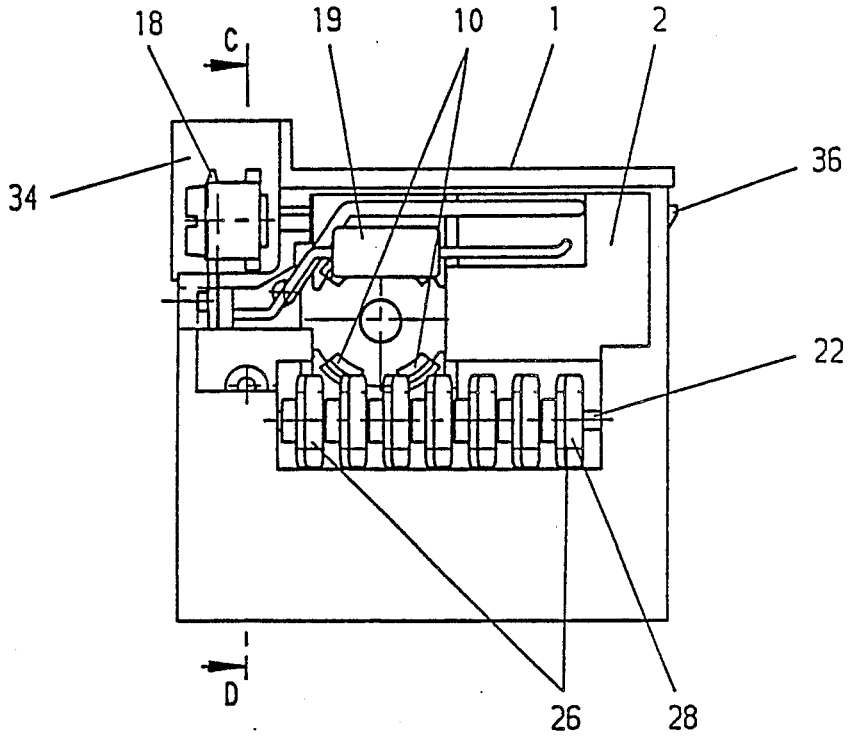
FIG. 5 is a rear elevation showing the meter of FIG. 1.
Figure 6:
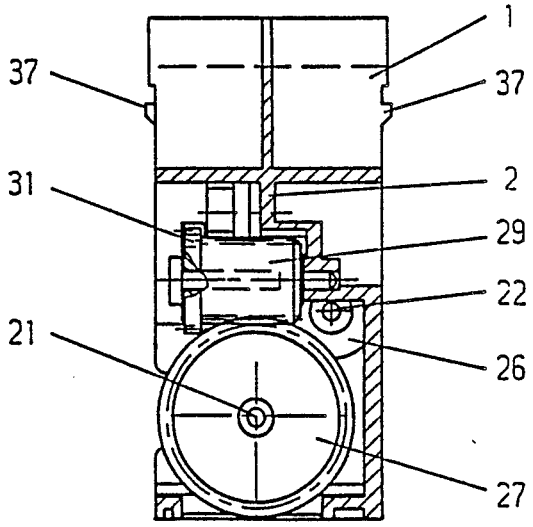
FIG. 6 is a sectional view taken on line C-D in FIG. 5.

A preferred embodiment of an elapsed-time meter in accordance with the invention is shown by way of example in the drawing and will be described more in detail hereinafter.

As is apparent from the drawing, the counter frame 1 comprises a partition 2 and a mounting plate 3. The drive motor is disposed between the partition 2 and the mounting plate 3 and comprises a rotor 4, which is rotatably mounted in the partition 2 by a bearing 6 and in the mounting plate 3 by a bearing 5. On the side that is remote from the partition 2, the mounting plate 3 carries axle pins 8, on which elements of the transmission 7 are rotatably mounted. On the side facing the partition 2, the mounting plate is integrally formed with resilient lugs 10, which cooperate with detent noses carried by the partition 2 to detachably fix the mounting plate 3 in position. Stator laminations 9 are interposed between the partition 2 and the mounting plate 3 and determine between the rotor bearings 5 and 6 an axial spacing which provides for an axial play of the rotor 4. Alternate stator laminations 9 have been inserted in mutually opposite directions. The frame 1 is integrally formed with retaining portions 11 and 12 for holding the bearing 5 for the rotor 4 in a receptacle provided in the mounting plate 3, so that the bearing 5 is axially aligned with the bearing 6.

The stator laminations 9 comprise core portions 14, which extend through the exciter coil 13 of the motor and hold said coil in position. The partition 2 is integrally formed with locating portions 15, 16, which define the air gap between the stator laminations 9 and the rotor 4. The exciter coil 14 is energized via electric terminals carried by terminal carriers 17, 18 provided in a recess 34 of the partition 2. Said terminal may selectively consist of plugs or screw clamps. A series resistor 19 serves to derive the voltage applied to the exciter coil 14 from the supply voltage.

The assembled set of wheels 20 on the shaft 21 are held in the frame 1 by means of integrally formed resilient arms 23, 24, which cooperate with detents so that the digit wheels can be preset by means of the shaft by ratcheting over the carry-over pinions 16 mounted on the shaft 22. By means of a gear 31, a worm 29 is operatively connected to the transmission 7 and drives the least significant digit wheel 27, which is provided with an operation detector 33. In that case the least significant digit wheel 27 acts via the first carry over pinion 28 on the succeeding more significant digit wheels 25, which are provided with gears. A pinion 30 having two sets of teeth is mounted on the rotor shaft 4*a*. One of said gears drives the transmission 7 and the other the reverse-preventing means 32.

Figure 7:
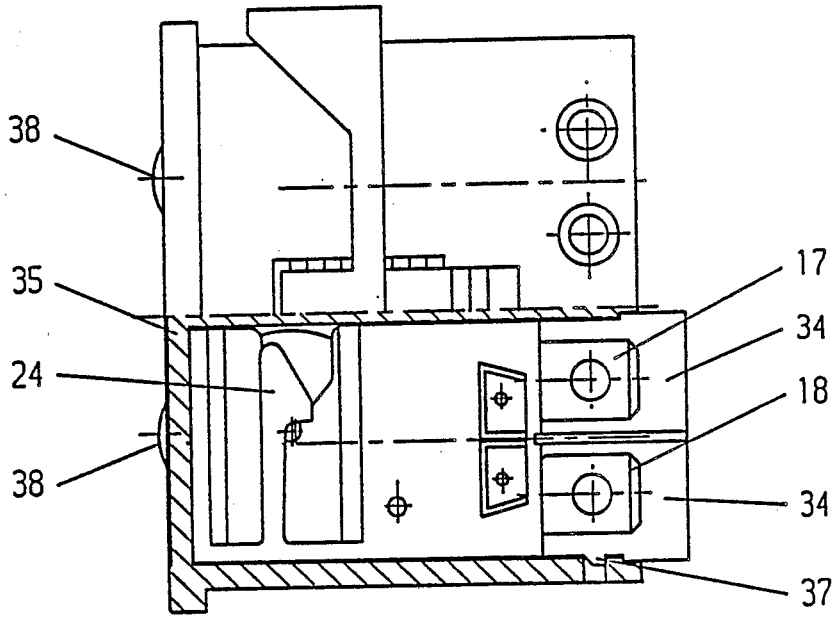
FIG. 7 shows a meter housing which is adapted to selectively accommodate one or two mechanical counters.

The frame 1 provided with the counter may be inserted into a housing. As is shown in FIG. 7, two or more counters provided with respective counter frames 1 may be inserted into a common housing and may be held in position in the housing 35 by detent elements 36, 37.

The windows 38 for exposing the digits to be indicated may consist in the usual manner of magnifiers to that the digits will be more easily legible.

I claim:

1. In an elapsed-time meter comprising a counter having indicating digit wheels, an electric motor comprising a rotor and stator laminations, a transmission operatively connecting said rotor to said digit wheels to rotate the latter, and a housing accommodating a set including said counter, said motor and said transmission, the improvement residing in that said meter comprises a frame that is accommodated in said housing and includes a partition and a mounting plate spaced from said partition, said partition carries detent noses extending toward said mounting plate, said mounting plate is integrally formed with resilient lugs cooperating with said detent noses to fix said mounting plate to said partition, said rotor is rotatably mounted at one end in said partition and at the other end in said mounting plate, and said transmission is mounted on said mounting plate on the side thereof which is remote from said partition.

2. The improvement set forth in claim 1, wherein said rotor is rotatably mounted in said partition and said mounting plate in respective bearings, alternating ones of said stator laminations extend in mutually opposite directions between said partition and said mounting plate, and said stator laminations define for said bearings an axial spacing which provides for an axial play of said rotor.

3. The improvement set forth in claim 2, wherein two of said stator laminations are provided.

4. The improvement set forth in claim 1, wherein said rotor is rotatably mounted in said partition and in said mounting plate in respective bearings and said frame is integrally formed with retaining portions by which said bearings are held in axial alignment.

5. The improvement set forth in claim 4, wherein said retaining portions are integrally formed in said mounting plate.

6. The improvement set forth in claim 1, wherein alternating ones of said stator laminations extend in mutually opposite directions between said partition and said mounting plate and comprise mutually overlapping core portions, and said motor comprises a coil, which is mounted on said overlapping core portions.

7. The improvement set forth in claim 1, wherein said mounting plate carries axle pins on the side that is remote from said partition and said transmission comprises gears rotatably mounted on said axle pins.

8. The improvement set forth in claim 1, wherein said frame comprises a wall that is formed with a recess, terminal carriers are provided in said recess, and terminals electrically connected to said motor are detachably mounted on said terminal carriers.

9. The improvement set forth in claim 8, wherein said terminals consist of plugs.

10. The improvement set forth in claim 8, wherein said terminals comprise screw clamps.

11. The improvement set forth in claim 1, wherein said frame comprises a digit wheel receptacle, said digit wheels are included in a preassembled set, which is detachably mounted in said digit wheel receptacle, said transmission comprises carry-over pinions cooperating with said digit wheels, and said frame is integrally formed with resilient arms for detachably mounting said set in such a manner that said digit wheels are adapted to be adjusted by ratcheting over said carry-over pinions.

12. The improvement set forth in claim 1, wherein said housing is provided with at least one window exposing said digit wheels.

13. The improvement set forth in claim 12, wherein a plurality of said frames are accommodated in said housing and a plurality of said sets are mounted on respective ones of said frames.

14. The improvement set forth in claim 1, wherein a resistor is connected in series with said electric motor and serves to energize said motor with a rated voltage derived from a supply voltage which differs from said rated voltage.

* * * * *